US009824575B2

(12) United States Patent
Smith et al.

(10) Patent No.: US 9,824,575 B2
(45) **Date of Patent: *Nov. 21, 2017**

(54) SYSTEM AND METHOD FOR USING ALARM SYSTEM ZONES FOR REMOTE OR MOBILE OBJECTS

(71) Applicant: Numerex Corp., Atlanta, GA (US)

(72) Inventors: Jeffrey O. Smith, Dallas, TX (US); James Zavorski, Cumming, GA (US)

(73) Assignee: Numerex Corp., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/721,472

(22) Filed: May 26, 2015

(65) Prior Publication Data

US 2015/0254966 A1 Sep. 10, 2015

Related U.S. Application Data

(63) Continuation of application No. 13/865,601, filed on Apr. 18, 2013, now Pat. No. 9,041,527.

(60) Provisional application No. 61/636,330, filed on Apr. 20, 2012.

(51) Int. Cl.

| | |
|---|---|
| ***G08B 23/00*** | (2006.01) |
| ***G08B 25/00*** | (2006.01) |
| ***G08B 25/08*** | (2006.01) |
| ***G08B 25/14*** | (2006.01) |
| ***G08B 13/00*** | (2006.01) |
| ***G08B 25/10*** | (2006.01) |

(52) U.S. Cl.

CPC ..... *G08B 25/08* (2013.01); *G08B 13/00* (2013.01); *G08B 25/00* (2013.01); *G08B 25/10* (2013.01); *G08B 25/14* (2013.01)

(58) Field of Classification Search

CPC ..... G08B 25/00; G08B 25/14; G08B 13/00; G08B 13/08; G08B 13/22; B60R 25/00; B60R 25/02

USPC ..... 340/517, 521, 531, 539.13, 541, 568.1, 340/571, 573.1; 455/404.1, 404.2

See application file for complete search history.

(56) References Cited

U.S. PATENT DOCUMENTS

| | | | | |
|---|---|---|---|---|
| 5,917,409 | A * | 6/1999 | Wang | G08B 29/24 340/506 |
| 6,204,760 | B1 * | 3/2001 | Brunius | G08B 25/001 340/506 |
| 7,667,622 | B2 * | 2/2010 | Knoska | G01M 17/00 340/311.2 |
| 8,179,256 | B2 * | 5/2012 | Crisp | G08B 25/08 340/541 |
| 8,214,494 | B1 * | 7/2012 | Slavin | G08B 25/08 709/203 |
| 2008/0061923 | A1 * | 3/2008 | Simon | G08B 25/009 340/3.1 |
| 2010/0026495 | A1 * | 2/2010 | Fast | G01S 5/0018 340/572.1 |

(Continued)

*Primary Examiner* — Hung T Nguyen
(74) *Attorney, Agent, or Firm* — King & Spalding LLP

(57) ABSTRACT

An alarm system for monitoring a local premises and multiple remote objects is described. The system includes sensors in the local premises, an alarm panel connected to the sensors in the local premises, and remote objects having alarm systems in communication with the alarm panel. The remote objects are assigned a zone in the alarm panel to represent the remote object, such that an alarm condition at the remote object is reported as an alarm condition in the assigned zone.

18 Claims, 3 Drawing Sheets

(56) References Cited

U.S. PATENT DOCUMENTS

2010/0073183 A1* 3/2010 Edwards ..... B60R 25/00
340/670

* cited by examiner

SYSTEM AND METHOD FOR USING ALARM SYSTEM ZONES FOR REMOTE OR MOBILE OBJECTS

CROSS REFERENCE TO RELATED INFORMATION

This application is a continuation patent application of Ser. No. 13/865,601 filed Apr. 18, 2013, (now U.S. Pat. No. 9,041,527), which claims the benefit of U.S. Provisional Patent Application No. 61/636,330, filed Apr. 20, 2012, the contents of which are hereby incorporated herein in its entirety.

TECHNICAL FIELD

The present disclosure is directed to premise alarm systems, and more particularly to premise alarm systems that can monitor remote or mobile objects.

BACKGROUND OF THE INVENTION

Premise monitoring alarms are extremely common in both commercial and residential applications. A typical prior art alarm configuration is shown in FIG. 1. The alarm 100 consists of various sensors connected to a central monitoring panel 101. The sensors can include any type of sensor, such as contact sensors 116 for doors and windows, motion detectors 115 to detect motion in specific areas, glass break sensors 114 to detect a broken window, and smoke/fire alarms 113. In many instances, these sensors are separated into specific zones, such as zones 1, 2, 3 and 4, that correspond to a particular area, room, or set of rooms in the building or house, or that correspond to a particular type of alarm, i.e. fire, intrusion, etc.

The control panel is also connected to various other elements that make up the alarm system, such as a monitoring center 107, a siren 106, a back-up power supply 112, remote keypads 109, auxiliary and configuration ports 110, fault relays 108, etc. This allows the alarm panel 101 to communicate the status of the alarm system 100 to the monitoring center 107 should a problem at one of the sensors be detected. In addition to the fault condition, the monitoring panel 101 can indicate the zone in which the alarm is occurring. The alarm system 100 or a monitoring company can then contact the owner of the premises and notify them as to the alarm condition, zone, and sensor type that is causing the alarm.

While the current system works well, the defined zones are limited to the premises being monitored. In the current connected world, it would be preferable if the utility of the premise alarm system could be utilized to indicate problems in remote or mobile premises or items.

BRIEF SUMMARY OF THE INVENTION

In preferred embodiments, the present invention describes an alarm system for monitoring a local premises and multiple remote objects. The system includes sensors in the local premises, an alarm panel connected to the sensors in the local premises, and remote objects having alarm systems in communication with the alarm panel. The remote objects are assigned a zone in the alarm panel to represent the remote object, such that an alarm condition at the remote object is reported as an alarm condition in the assigned zone.

In another preferred embodiment a method of monitoring remote objects for alarm conditions is described. The method includes assigning each remote object to an assigned zone in an alarm panel, and monitoring the remote objects for alarm conditions.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

As described, current alarm system configurations are limited to monitoring a single location, building or premises. If the owner of the alarm system has multiple items that need to be monitored, multiple alarm systems and alarm panels are required, each with their own monitoring expenses. Faults at each panel could generate separate alarms from potentially different monitoring companies. Further, most monitored alarm systems cannot monitor mobile items such as cars, RVs, motorcycles or other mobile items that could be monitored.

Figure 1:
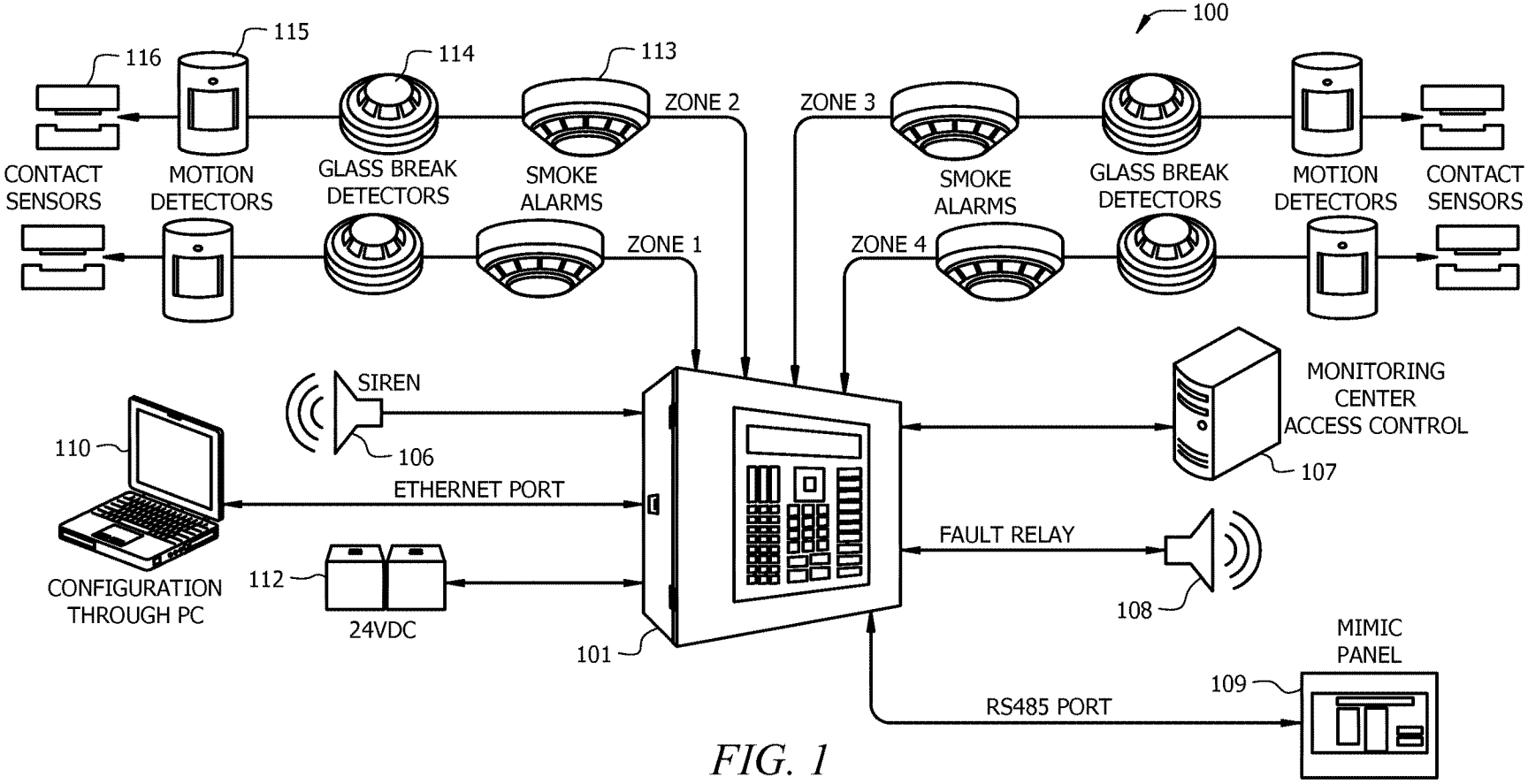
FIG. 1 (Prior Art)
FIG. 1 is a prior art premises alarm configuration.
Figure 2:
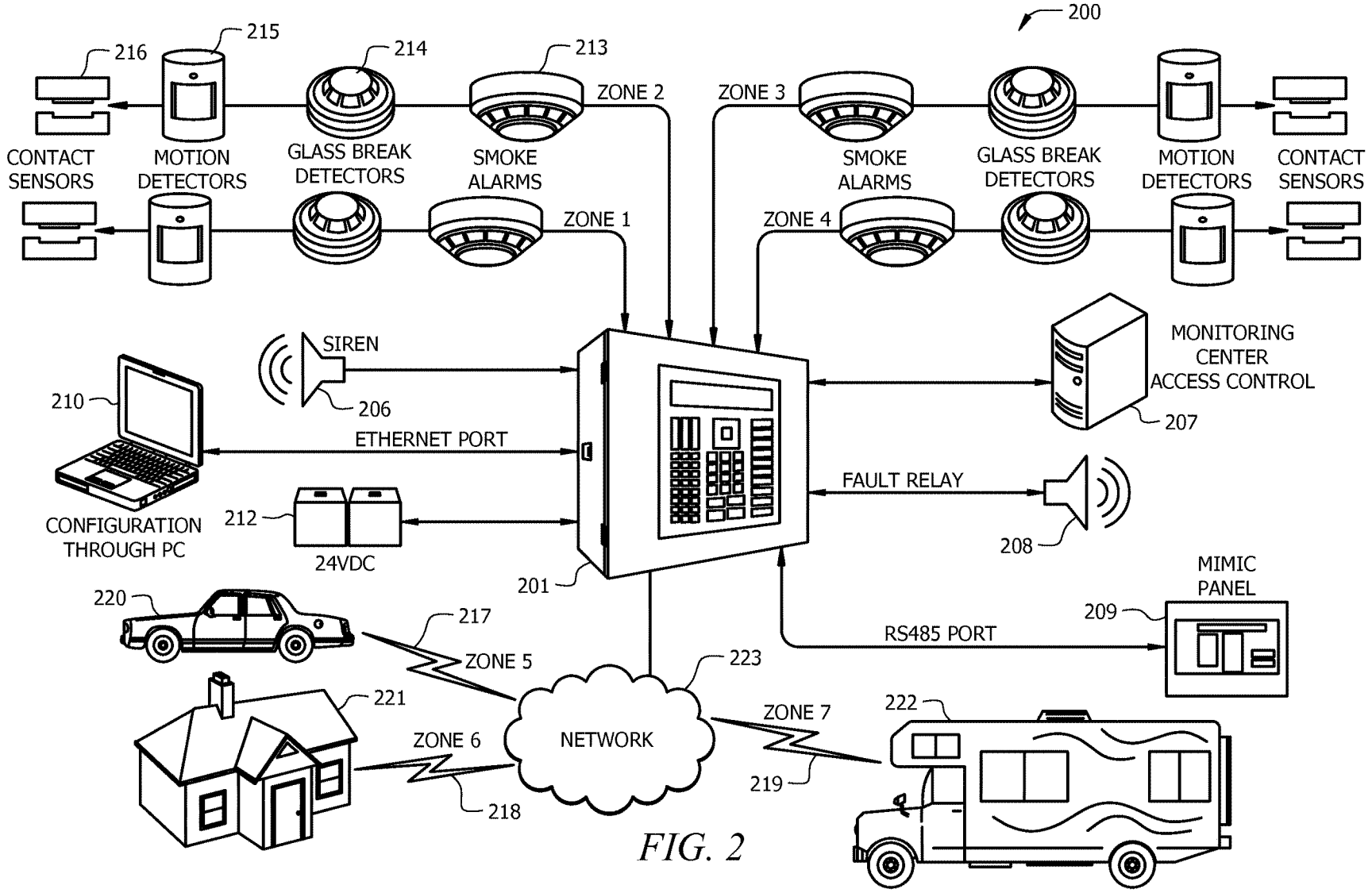
FIG. 2 is an embodiment of an alarm configuration configured to monitor remote or mobile items or premises according to the concepts described herein.

The present invention expands the capabilities of existing alarm systems and alarm panels by allowing multiple remote or mobile premises, objects and items to be connected into an alarm panel, thereby allowing that alarm panel to monitor the status of those objects and to report any alarm conditions through a single communications channel and protocol. An example of such an alarm system is shown in FIG. 2. In addition to the traditional monitoring of a multi-zone premises or building, the alarm system 200 of the present invention allows remote premises 221, such as remote buildings or vacation homes, vehicles, such as automobiles 217, recreational vehicles 222, boats, or any other object to be remotely connected into the alarm panel 201 and represented as a separate zone in the alarm system. In the example of FIG. 2, the second home 221 is represented as alarm zone 6, the automobile is represented by zone 5 and the RV is represented by zone 7.

In this manner, if there is an alarm condition at the owner's vehicle, the alarm panel will return the alarm condition for zone 5 and potentially the type of alarm if the vehicle is equipped with multiple sensor types. Additionally, the vehicle alarm system, or the alarm system associated with any mobile object can have location determination units, such as GPS or cellular, and can be programmed to return location information to the alarm system 200 in addition to the alarm code. When the owner is notified of the alarm in zone 5 they will know that zone 5 corresponds to their vehicle and can act accordingly. The remote objects can be connected to the alarm panel over any type of appropriate network, including cellular, wireless, satellite, radio frequency, or any combination thereof.

Upon an alarm condition at the remote object, the alarm on the remote object will send a signal to the alarm panel 201 over the network connection 217, 218 or 219 using network 223. That alarm signal will then be reported to the monitoring center 207, the owner, or both by a telephone call, email, text message, through a smart phone app, or by any other mechanism for notifying the owner or monitoring center supported by the alarm system 200.

Beyond the extension of alarm system 200 to include remote zones 5, 6 and 7, alarm system 200 functions essentially as a traditional premise alarm system. The alarm 200 consists of various sensors connected to the central monitoring panel 201. The sensors can include any type of sensor, such as contact sensors 216 for doors and windows, motion detectors 215 to detect motion in specific areas, glass break sensors 214 to detect a broken window, smoke/fire alarms 213, and any other type of sensor that would be useful in an alarm system. These sensors can be separated into specific zones, such as zones 1, 2, 3 and 4, that correspond to a particular area, room, or set of rooms in the building or house, or that correspond to a particular type of alarm, i.e. fire, intrusion, etc. The control panel 201 is also connected to various other elements that make up the alarm system, such as, a siren 206, a back-up power supply 212, remote keypads 209, auxiliary and configuration ports 210, fault relays 208, etc. This allows the alarm panel 201 to communicate the status of the alarm system 200 to the monitoring center 207 should a problem at one of the sensors be detected.

Figure 3:
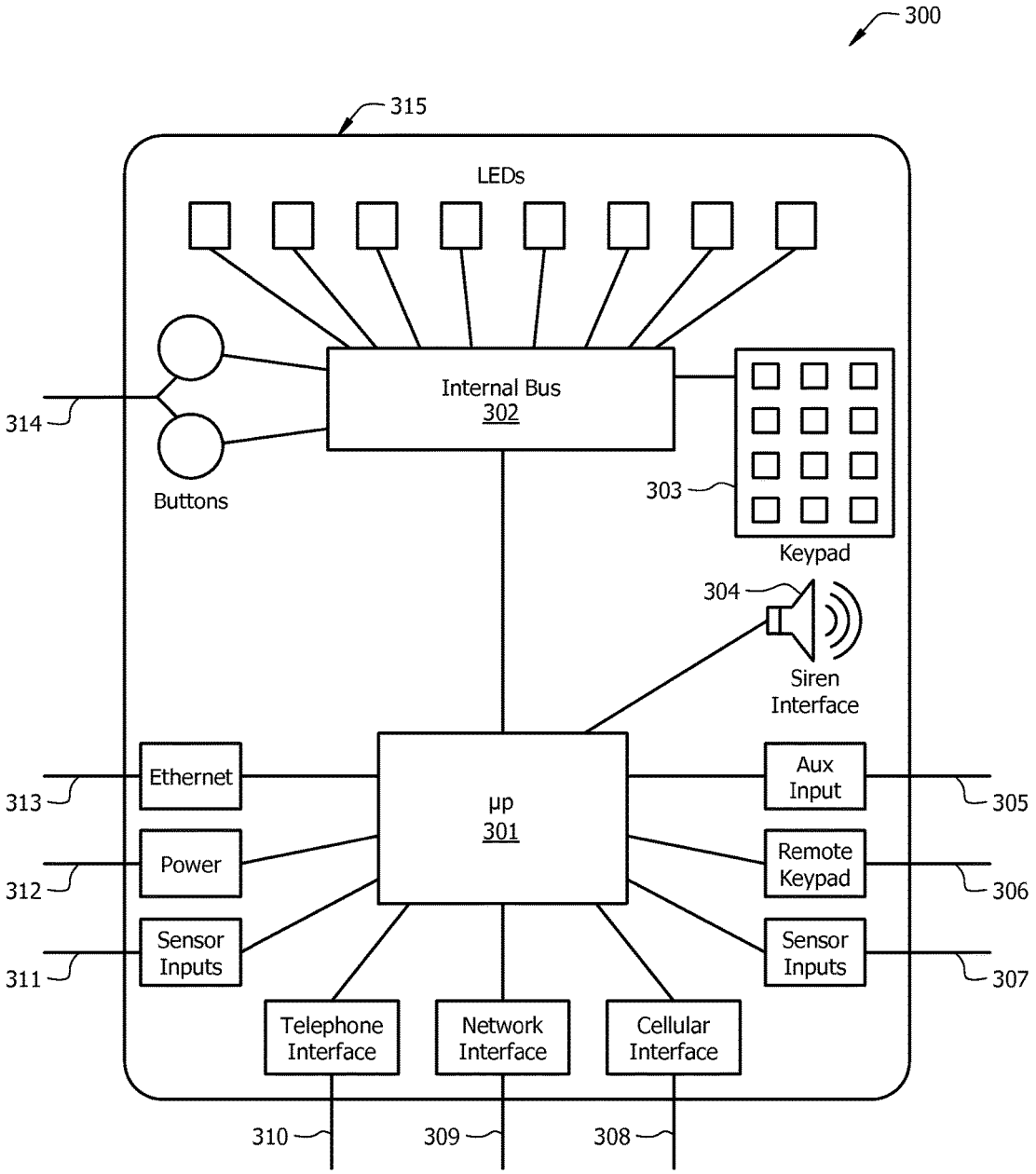
FIG. 3 is a block diagram of an embodiment of an alarm control panel according to the concepts described herein.

Referring now to FIG. 3, an exemplary embodiment of an alarm panel/controller 300 according to the present invention is shown. The alarm panel 300 is housed in enclosure 315 and controlled primarily by a microprocessor 301 or other logic circuitry to behave in a preprogrammed manner. The microprocessor 301 is connected to the local sensors over one or more sensor inputs 307, 311. As discussed above, the sensors can be connected in multiple zones to provide information as to the alarm condition. The microprocessor 301 is also connected over a bus 302 to LED indicators, a local keypad 303 and other input buttons 314 in the alarm panel console 315. Various other connections are provided to improve the functionality of the alarm panel 300, such as emergency power supply 312, remote keypads 306, configuration inputs 313, and auxiliary connectors 305.

The alarm panel also includes multiple communications interfaces 308, 309, 310 to allow the panel to connect to the monitoring center and, in the preferred embodiments, remote objects to be monitored by the alarm system. The communication interfaces 308, 309, 310 can include any types of interfaces that would be useful based on the location of the panel and the types of remote object begin monitored, including such interfaces as a landline telephone interface 310, a cellular telephone interface 308 and a network interface 309, which can be either or both wired and wireless. Typically, the alarm panel 300 communicates with the monitoring center using the telephone interface 310, but can use the cellular 308 or network interfaces 309 if the telephone line is inoperable or not present.

Remote objects being monitored by the alarm system of the present invention can communicate with the alarm system over any of these interfaces, but most typically would use the network interface 309 or cellular interface 308 to send signals to and receive signals from the alarm panel. Those messages can be in any format including SMS messages, MMS messages, TCP/IP signals, or other protocols and open or proprietary interfaces.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A system comprising:

an alarm panel;

a first alarm system disposed in a first premises at a first location to monitor an alarm condition in the first premises, wherein the first alarm system is assigned a first zone in the alarm panel to represent assets that are monitored by the first alarm system at the first premises, and wherein the alarm panel is connected to one or more sensors of the first alarm system in the first premises; and a remote alarm system disposed in a second premises that is different from and outside of the first premises and associated with monitoring another alarm condition in a remote object at the second premises in a second location, wherein the second location is different from and remote from the first location, wherein the alarm panel is communicatively coupled to one or more sensors of the remote alarm system at the second premises, and wherein the remote alarm system is assigned a second zone in the alarm panel to represent the remote object at the second premises such that the other alarm condition at the remote object is transmitted when the other alarm condition in the second zone is detected.

2. The system of claim 1, further comprising multiple remote alarm systems associated with multiple remote objects.

3. The system of claim 1, wherein the remote object is a mobile object.

4. The system of claim 3, wherein the mobile object is a vehicle.

5. The system of claim 3, wherein the mobile object includes a location determination unit and reports the location of the mobile object along with the alarm condition and an identifier representing the second zone.

6. The system of claim 1, wherein the remote alarm system is communicatively coupled to the alarm panel via a cellular network.

7. The system of claim 1, wherein the remote alarm system is communicatively coupled to the alarm panel via Internet.

8. The system of claim 1, wherein the remote alarm system is communicatively coupled to the alarm panel via a telephone line.

9. The system of claim 1, wherein the alarm panel includes a telephone interface, a network interface, and a cellular interface.

10. The system of claim 1, wherein the alarm panel comprises:

a housing;

a microprocessor disposed in the housing;

a plurality of communication interfaces that are configured to communicatively couple the alarm panel to a monitoring center and the remote alarm system, wherein the plurality of communication interfaces include a landline telephone interface, a cellular interface, and a network interface, and wherein the alarm panel is configured to communicate with the monitoring center using the landline telephone interface as a default mode of communication; and wherein the alarm panel is configured to communicate with the monitoring center using one of the cellular interface and the network interface when the default mode of communication is inoperable.

11. A method comprising:

monitoring one or more assets at a first premises with a first system that is disposed in the first premises at a first location, wherein the first system is coupled to an alarm panel, and wherein the first premises is divided into multiple zones, each a separately monitored zone in the alarm panel;

assigning a remote alarm system to a zone in the alarm panel that is different than the multiple zones in the first premises, wherein the remote alarm system is disposed in a second premises that is different from and outside of the first premises and associated with monitoring a remote object at the second premises, wherein the remote alarm system is communicatively coupled to the alarm panel; and reporting an alarm condition at the remote alarm system as an alarm condition in the zone assigned to the remote object.

12. The method of claim 11, further comprising multiple remote alarm systems associated with multiple remote objects.

13. The method of claim 11, wherein the remote object is a mobile object.

14. The method of claim 13, wherein the mobile object is a vehicle.

15. The method of claim 13, wherein the mobile object includes a location determination unit and reports the location of the mobile object with the alarm condition.

16. The method of claim 11, wherein the remote alarm system is communicatively coupled to the alarm panel via a cellular network.

17. The method of claim 11, wherein the remote alarm system is communicatively coupled to the alarm panel via Internet.

18. The system of claim 11, wherein the remote alarm system is communicatively coupled to the alarm panel via a telephone line.

* * * * *